US006400913B1

(12) United States Patent
de Jong et al.

(10) Patent No.: US 6,400,913 B1
(45) Date of Patent: Jun. 4, 2002

(54) CONTROL REGISTRATION AND MOTION QUALITY OF A TANDEM XEROGRAPHIC MACHINE USING TRANSFUSE

(75) Inventors: Joannes N. M. de Jong, Suffem; Lloyd A. Williams, Mahopac, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/736,986

(22) Filed: Dec. 14, 2000

(51) Int. Cl.[7] ..... G03G 15/16; G03G 15/00

(52) U.S. Cl. ..... 399/66; 318/9; 399/75; 399/307

(58) Field of Search ..... 399/66, 36, 37, 399/88, 75, 67, 165, 167, 227, 307, 308, 328; 198/804; 318/9, 2, 15

(56) References Cited

U.S. PATENT DOCUMENTS 5,200,782 A 4/1993 Castelli et al. ..... 399/165
5,373,355 A 12/1994 Ando et al. ..... 399/301
5,384,592 A 1/1995 Wong ..... 347/116
5,387,962 A 2/1995 Castelli et al. ..... 399/165
5,508,789 A 4/1996 Castelli et al. ..... 399/8
5,689,764 A * 11/1997 Fukuchi et al. ..... 399/75
5,708,950 A 1/1998 Badesha et al. ..... 399/333
5,729,788 A * 3/1998 Hirohashi et al. ..... 399/66
5,837,408 A 11/1998 Parker et al. ..... 430/42
5,991,565 A * 11/1999 Hanyu et al. ..... 399/328 X

* cited by examiner

*Primary Examiner*—Sophia S. Chen
(74) *Attorney, Agent, or Firm*—Perman & Green, LLP

(57) ABSTRACT

Apparatus and method for controlling picture quality in a transfuse xerographic machine has independent velocity control of image transfer and transfuse belts or rollers when they are disengaged from each other and a common velocity control when they are engaged with each other. The machine can be a monochrome or color copier or printer. Various rollers can be the drive and/or the encoder rollers.

28 Claims, 2 Drawing Sheets

CONTROL REGISTRATION AND MOTION QUALITY OF A TANDEM XEROGRAPHIC MACHINE USING TRANSFUSE

CROSS-REFERENCE TO RELATED APPLICATION

NOT APPLICABLE

STATEMENT REGARDING FEDERALLY SPONSORED RESEARCH OR DEVELOPMENT

NOT APPLICABLE

BACKGROUND OF THE INVENTION

1. Field of the Invention

This invention relates to electrophotographic printing. More specifically, this invention relates to electrophotographic printers which include a transfusing member.

2. Description of the Related Art Including Information Disclosed Under 37 CFR 1.97 AND 1.98 Prior Art Electrophotographic marking is a well known and commonly used method of copying or printing original documents. Electrophotographic marking is typically performed by exposing a light image of an original document onto a substantially uniformly charged photoreceptor. In response to that light image, the photoreceptor discharges so as to create an 2 v electrostatic latent image, thereby forming a toner powder image. That toner powder image is then transferred from the photoreceptor, either directly, or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creation of another image.

The foregoing generally describes a typical black and white electrophotographic marking machine. Electrophotographic marking can also produce color images by repeating the above process once for each color that makes the color image. For example, the charged photoconductive surface may be exposed to a light image which represents a first color, say cyan (C). The resultant electrostatic latent image can then be developed with cyan toner particles to produce a cyan image which is subsequently transferred to a marking substrate. The foregoing process can then be repeated for a second color, say magenta (M), then, a third color, say yellow (Y), and finally a fourth color, say black (B). Beneficially each color toner image is transferred to the marking substrate in super-imposed registration so as to produce the desired composite toner powder image on the marking substrate.

The color printing process described above superimposes the various color toner powder images directly onto a marking substrate. Another electrophotographic color printing process uses an intermediate transfer member or belt (ITB). In systems which use such an ITB, successive toner images are transferred in superimposed registration from the photoreceptor onto the ITB. Only after the composite toner image is formed on the ITB is that image transferred and fused onto the marking substrate, e.g., paper.

The most common developing materials are dry powder toners. Dry powder developers are typically comprised of not only toner particles but also of carrier granules. The toner particles triboelectrically adhere to the carrier granules until the toner particles are attracted onto the latent image. An alternative to dry powder developing materials are liquid developers. Liquid developers, also referred to a liquid inks, have a liquid carrier into which toner particles are dispersed. When developing with liquid developers both the toner particles and the liquid carrier are advanced into contact with the electrostatic latent image. The liquid carrier is then removed by blotting, evaporation, or by some other means, leaving the toner particles behind.

ITBs can also be used in the fusing process. ITBs which are used in fusing are referred to herein as transfusing members or belts (TB), and the combined processes of transferring and fusing is called transfusing. Transfusing is highly desirable since the size and cost of transfusing printing machines can be less than comparable printing machines which use a separate transfer station and fusing station. Other advantages such as improved image quality can also be obtained by transfusing. Members are usually pinched between one or more contact rollers and a backup roller such that a fusing pressure is created between the nip of the backup roller and the transfusing member and heat is applied to the toner image. The combination of heat and pressure causes the toner image to fuse onto the marking substrate.

During the transfuse process, velocity control, e.g. by servo systems, of the photoreceptor drum and ITB is important to achieve a high quality image, e.g., proper color registration, lack of smearing, etc. The interface between the photoreceptor drum and the ITB is a slip interface. Hence, the motion of the four photoreceptors (C,M,Y,B) and the ITB can be independently controlled by separate servo systems. However, since the transfuse belt is a very sticky belt, no slip in the transfer nip between the ITB and TB is possible. Due to variations in encoding and mechanical tolerances, two different velocity measurements will be produced. If two different servo systems are used, they will have conflicting requirements. This makes independent velocity control of ITB and transfuse belt impossible.

It is therefore desirable to have method and apparatus for controlling the velocity of two or more engaged members.

BRIEF SUMMARY OF THE INVENTION

An apparatus comprises first and second members having engaged and disengaged modes; a first velocity controller for controlling the velocity of the first member when it is disengaged from the second member; a second velocity controller for controlling the velocity of the second member when it is disengaged from the first member; one of said controllers commonly controlling both of said members when they are engaged.

A process comprises controlling the velocity of a first member; independently controlling the velocity of a second member when said first and second members are mutually disengaged; and commonly controlling the velocity of said members when said members are engaged.

Xerographic apparatus comprises at least one photoreceptor module; an image transfer member engaging said module; a transfuse member engagable and disengagable with said image transfer member; an image transfer member servo controller controlling the velocity of said image member when said members are disengaged; a transfuse member servo controller controlling the velocity of said transfuse member when said members are disengaged, one of said controllers controlling both of said members when they are mutually engaged.

DETAILED DESCRIPTION OF THE PREFERRED EMBODIMENT

Figure 1:
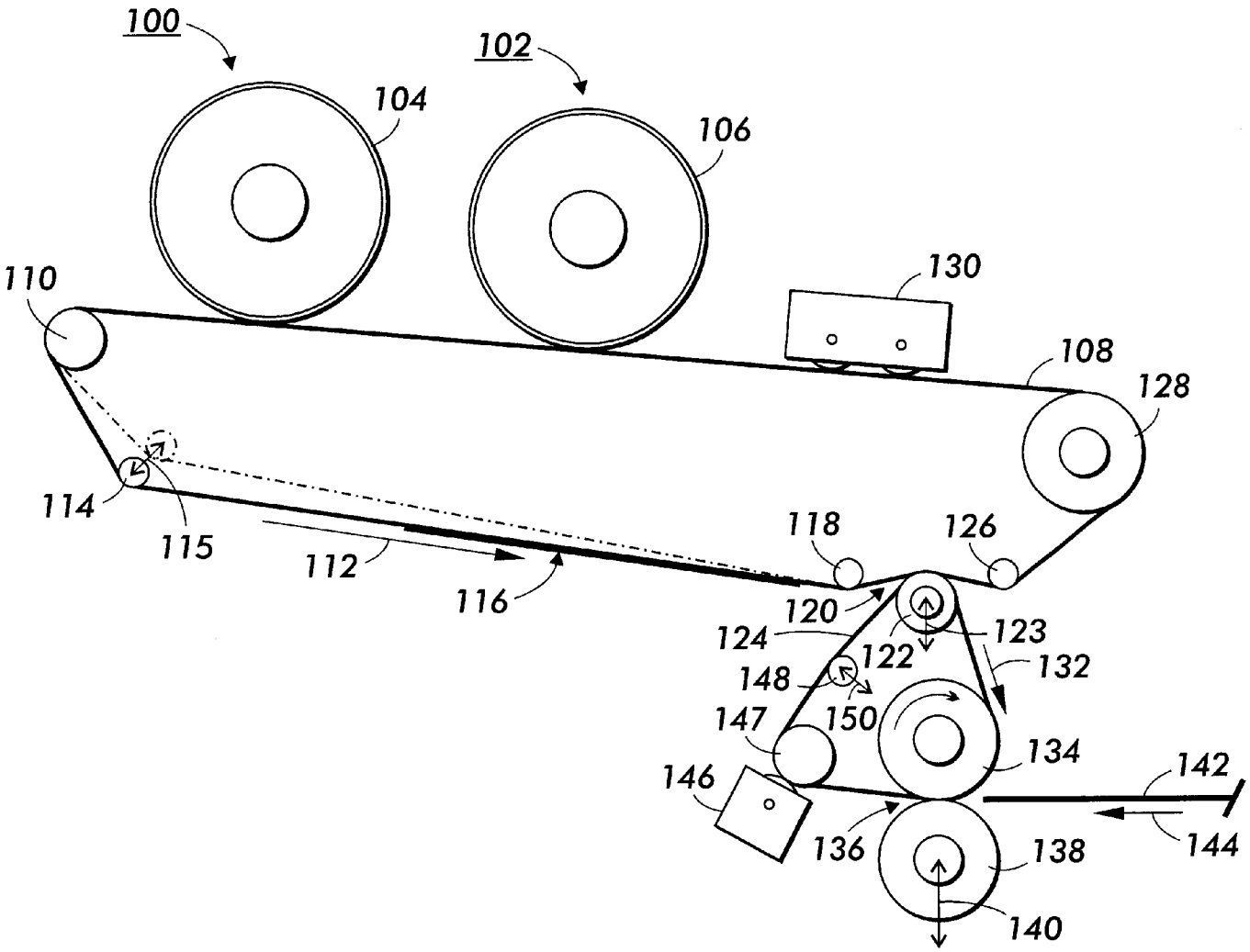
FIG. 1 is a simplified drawing of a xerographic copying machine incorporating the present invention.

FIG. 1 shows photoreceptor modules 100 and 102. Although two modules are shown, for monochrome reproduction only one is needed, while for color reproduction there are normally three or four modules present. As known in the art, each module comprises a charging station having at least one corona generator, an imaging station having a raster scanner, a developing station, etc., (none shown), which are respectively disposed around photoconductor coated drums 104 and 106. As known in the art, belts could be used in place of drums 104 and 106. Drums 104 and 106 engages an image transfer member such as an ITB 108 which is driven by an ITB drive roller 110 in the direction indicated by arrow 112 in order to form an image on ITP 108. In turn, roller 110 is driven by a motor (shown in FIG. 2) and has a shaft encoder (also shown in FIG. 2), e.g., an optical tachometer, coupled to it. After passing a drive roller 110, ITB 108 engages a tensioning roller 114, which is movable in the directions indicated by an arrow 115 to adjust the tension in ITB 108. Then an image 116 on the ITB 108, which is due to the action of at least one of modules 100 and 102, passes an idler roller 118 and enters a transfer nip 120 comprising a transfer roller 122 in order to transfer image 116 onto a transfuse member such as a TB 124. Roller 122 is mounted so that it can move as indicated by arrow 123 in order to engage or disengage ITB 108 with TB 124. ITB 108 then passes a TB drive roller 126, a steering roller 128, and to remove image 116 a cleaning station 130. ITB 108 then returns to modules 100 and 102 to receive a new image. It will be appreciated that any one or more of rollers 110, 114, 118, 120, 128 or some other roller (not shown), could also be drive rollers for ITB 108 and that the shaft encoder (shown in FIG. 2) could also be on any of these rollers, not necessarily on whichever roller is the drive roller.

TB 124 passes over a TB transfer roller 122 in the direction indicated by arrow 132. TB 124 then goes around an idler roller 134 and enters a transfuse nip 136 comprising an idler roller 134 and a transfuse roller 138. Roller 138 is mounted so that it can move as indicated by arrow 140 in order to disengage rollers 134 and 138 when the apparatus is not in use to prevent flat spots thereon. Image 116 is transfused onto a paper 142, which is also entering nip 136 as indicated by an arrow 144. Paper 142 then emerges from nip 136 with image 116 on it due to heat and/or pressure applied by rollers 134 and 138. TB 124 then goes to a cleaning station 146 in order to remove the image thereon. Disposed opposite cleaning station 146 is a drive roller 147, which is coupled to a motor (shown in FIG. 2) in order to drive TB 124. A shaft encoder (shown in FIG. 2) is also coupled to roller 147. TB 124 then goes to a tensioning roller 148 which is movable as indicated by arrow 150 in order to adjust the tension of TB 124. Thereafter TB 124 returns to nip 120 to receive a new image. It will be appreciated that any one or more of rollers 123, 134, 140, 147, 150, or some other roller (not shown), could also be drive rollers for TB 124 and that the shaft encoder could be on any of these rollers, not necessarily whichever roller is the drive roller. It will be further appreciated that ITB 108 and TB 124 could also comprise drums or rollers.

Figure 2:
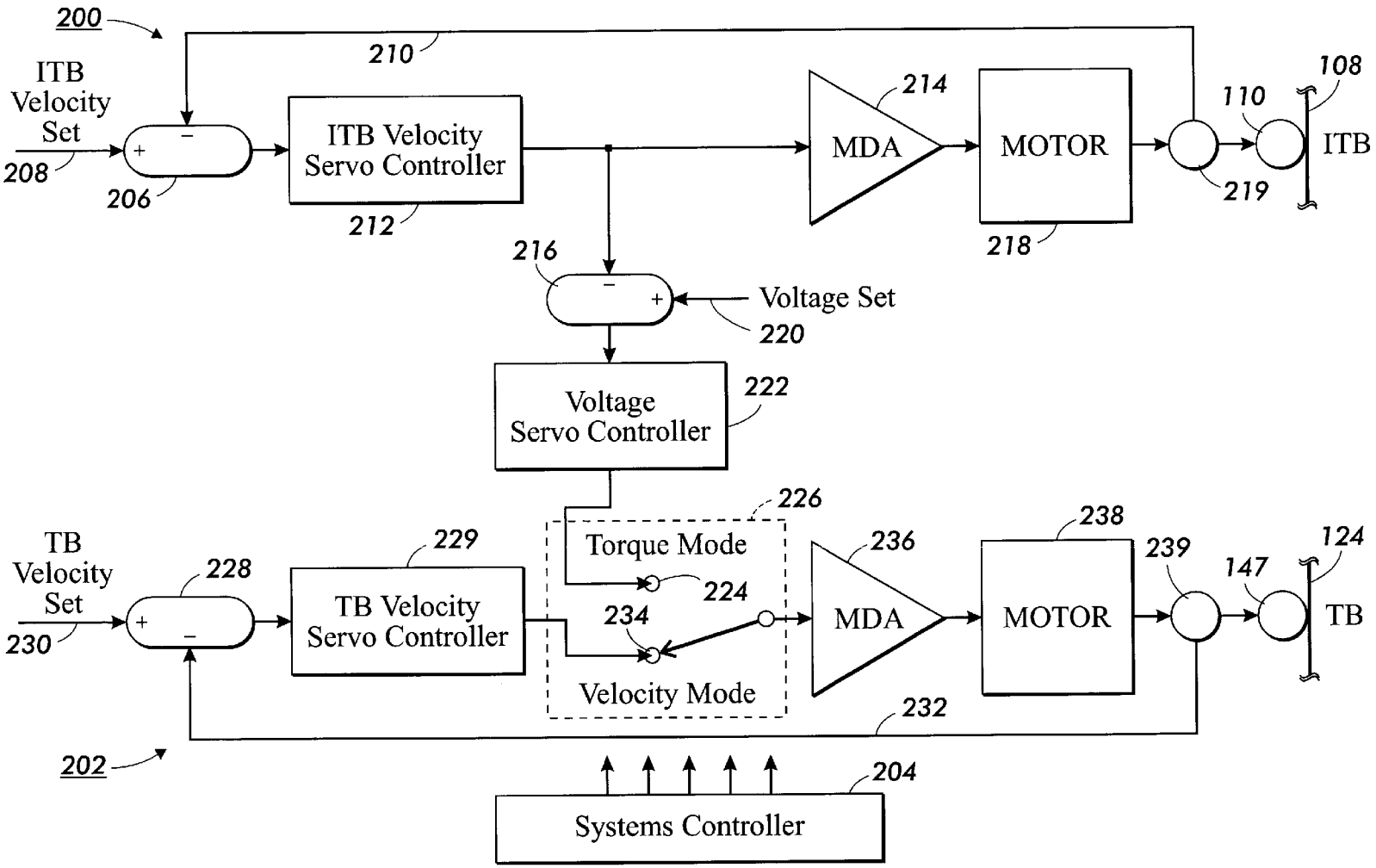
FIG. 2 is a block diagram of the present invention.

In FIG. 2 is shown a pair of feedback loops, an ITB loop 200 and a TB loop 202, both loops 200 and 202 being controlled by a microprocessor systems controller 204. As known in the art, controller 204 has compensation circuits to ensure the stability of loops 200 and 202. ITB loop 200 comprises a subtractor 206 which receives at its positive input a signal representing the ITB 108 velocity setpoint on line 208 from controller 204 and at its negative input a signal representing measured ITB 108 velocity on line 210. The output difference error signal is applied to an ITB velocity servo controller 212. The output signal from controller 212 is applied to motor drive amplifier (MDA) 214 and also to the negative input of subtractor 216. A motor 218 receives the output signal from MDA 214, and in turn, drives roller 110 and thus ITB 108. A shaft encoder 219 provides the measured ITB 108 velocity signal on line 210.

The subtractor 216 receives at its positive input a voltage setpoint signal on line 220 provided by controller 220. The output difference signal is applied to a voltage servo controller 222, which provides an output signal to torque assist contact 224 of switch 226.

TB loop 202 comprises a subtractor 228 which receives at its positive input a signal representing a TB 124 velocity setpoint on line 230 from controller 204 and at its negative input a signal representing measured TB 124 velocity on line 232. The output error difference signal is applied to a TB velocity servo controller 229. Controllers 212 and 229 can be any standard type as known in the art, e.g., type CMC 502 manufactured by Cleveland Controls Co. The output signal from controller 229 is applied to a velocity mode contact 234 of switch 226. If switch 226 is in the velocity mode, then this signal is further applied to an MDA 236. The output signal from MDA 236 is applied to a motor 238, which drives roller 147 and thus TB 124. A shaft encoder 239 provides the measured TB 124 velocity signal on line 232.

In operation, transfer nip 120 is initially disengaged, and controller 204 initially sets switch 226 in the velocity mode and provides the two velocity setpoint signals and the voltage setpoint signal. Each loop 200 and 202 operates independently to respectively control ITB 108 and TE 124, as known in the art. Then transfer nip 124 is engaged, and loop 200 continues to operate as a velocity control loop. However, controller 204 sets switch 226 in its torque assist mode so that MDA 236 receives its input from controller 222. The result is that loop 200 controls not only motor 218 and ITB 108, but also motor 238 and TB 124. Preferably, motor 238 provides just about enough torque (as determined by setpoint voltage on line 220) to make up for the additional load of TB 124 placed upon motor 218. Thus, there is a smooth, non-jerky, transition between modes that greatly reduces picture smearing and misregistration.

While the present invention has been particularly described with respect to preferred embodiments, it will be understood that the invention is not limited to these particular preferred embodiments, the process steps, the sequence, or the final structures depicted in the drawings. On the contrary, it is intended to cover all alternatives, modifications, and equivalents as may be included within the spirit and scope of the invention defined by the appended claims. In addition, other methods and/or devices may be employed in the method and apparatus of the instant invention as claimed with similar results.

What is claimed is:

1. An apparatus comprising:

first and second members having engaged and disengaged modes;

a first velocity controller for controlling the velocity of the first member when it is disengaged from the second member;

a second velocity controller for controlling the velocity of the second member when it is disengaged from the first member;

one of said controllers commonly controlling both of said members when they are engaged; and wherein said first member comprises an image transfer member.

2. The apparatus of claim 1, wherein said image transfer member comprises a belt.

3. The apparatus of claim 1, wherein said second member comprises a transfuse member.

4. The apparatus of claim 3, wherein the transfuse member comprises a belt.

5. The apparatus of claim 1, wherein said first velocity controller controls the velocity of both of said members when they are engaged.

6. The apparatus of claim 1, wherein the remaining controller provides drive to its respective member.

7. The apparatus of claim 6, wherein said drive is just about enough to make up for the additional load on said one controller due to the respective member of said remaining controller during engagement.

8. A process comprising:

controlling a velocity of a first member;

independently controlling a velocity of a second member when said first and second members are mutually disengaged; and commonly controlling the velocity of said members when said members are engaged, wherein said first member comprises an image transfer member.

9. The process of claim 8, wherein said image transfer member comprises a belt.

10. The process of claim 8 wherein said second member comprises a transfuse member.

11. The process of claim 10, wherein said transfuse member comprises a belt.

12. The process of claim 8, wherein said commonly controlling step comprises providing drive to a respective member of a controller.

13. The process of claim 12, wherein said drive is just about enough to make up for the additional load on one controller due to the first and second members during engagement.

14. Xerographic apparatus comprising:

at least one photoreceptor module;

an image transfer member engaging said module;

a transfuse member engagable and disengagable with said image transfer member;

an image transfer member servo controller controlling a velocity of said image transfer member when said members are disengaged; and a transfuse member servo controller controlling a velocity of said transfuse member when said members are disengaged;

one of said controllers controlling both of said members when they are mutually engaged.

15. The apparatus of claim 14, wherein said one controller comprises said image transfer member servo.

16. The apparatus of claim 15, wherein said drive is just about enough make up for the additional load on said one controller during engagement.

17. The apparatus of claim 14, wherein the remaining controller provides drive to its respective member.

18. An apparatus comprising:

first and second members having engaged and disengaged modes;

a first velocity controller for controlling the velocity of the first member when it is disengaged from the second member;

a second velocity controller for controlling the velocity of the second member when it is disengaged from the first member;

one of said controllers commonly controlling both of said members when they are engaged, wherein said second member comprises a transfuse member.

19. The apparatus of claim 18, wherein the transfuse member comprises a belt.

20. The apparatus of claim 18, wherein said first velocity controller controls the velocity of both of said members when they are engaged.

21. The apparatus of claim 18, wherein the remaining controller provides drive to its respective member.

22. The apparatus of claim 21, wherein said drive is just about enough to make up for the additional load on said one controller due to the respective member of said remaining controller during engagements.

23. An apparatus comprising:

first and second members having engaged and disengaged modes;

a first velocity controller for controlling the velocity of the first member when it is disengaged from the second member;

a second velocity controller for controlling the velocity of the second member when it is disengaged from the first member;

one of said controllers commonly controlling both of said members when they are engaged;

wherein the remaining controller provides drive to its respective member; and wherein said drive is just about enough to make up for the additional load on said one controller due to the respective member of said remaining controller during engagement.

24. A process comprising:

controlling a velocity of a first member;

independently controlling a velocity of a second member when said first and second members are mutually disengaged; and commonly controlling the velocity of said members when said members are engaged, wherein said second member comprises a transfuse member.

25. The process of claim 24, wherein said transfuse member comprises a belt.

26. The process of claim 24, wherein said commonly controlling step comprises providing drive to a respective member of a controller.

27. The process of claim 26, wherein said drive is just about enough to make up for the additional load on one controller due to the first and second members during engagement.

28. A process comprising:

controlling a velocity of a first member;

independently controlling a the velocity of a second member when said first and second members are mutually disengaged; and commonly controlling the velocity of said members when said members are engaged by providing drive to a respective member of a controller, wherein said drive is just about enough to make up for the additional load on one controller due to the first and second members during engagement.

* * * * *